US006312483B1

(12) United States Patent
Siniakevith

(10) Patent No.: US 6,312,483 B1
(45) Date of Patent: Nov. 6, 2001

(54) METHOD OF AND APPARATUS FOR PRODUCING COMBUSTIBLE GASES FROM PULVERIZED SOLID FUEL

(75) Inventor: Boris Siniakevith, Lwow (UA)

(73) Assignee: Ormat Industries Ltd., Yavne (IL)

( * ) Notice: Subject to any disclaimer, the term of this patent is extended or adjusted under 35 U.S.C. 154(b) by 0 days.

(21) Appl. No.: 08/107,633

(22) Filed: Aug. 18, 1993

(51) Int. Cl.[7] ..... C10J 3/68

(52) U.S. Cl. ..... 48/77; 48/197 R; 48/203; 48/206; 201/21

(58) Field of Search ..... 48/197 R, 202, 48/203, 206, 210; 201/31

(56) References Cited

U.S. PATENT DOCUMENTS

| | | | | |
|---|---|---|---|---|
| 2,579,397 | * | 12/1951 | Roetheli | 48/202 |
| 2,579,398 | * | 12/1951 | Roetheli | 48/206 |
| 2,582,712 | * | 1/1952 | Howard | 48/197 R |
| 2,588,075 | * | 3/1952 | Barr et al. | 48/206 |
| 2,609,283 | * | 9/1952 | Kalbach | 48/197 R |
| 2,622,973 | * | 12/1952 | Barr | 48/202 |
| 2,662,816 | * | 12/1953 | Kalbach | 48/202 |
| 3,966,633 | * | 6/1976 | Friedman | 48/197 R |
| 4,347,064 | * | 8/1982 | Reh et al. | 48/203 |
| 4,696,679 | * | 9/1987 | Albulescu et al. | 48/203 |
| 4,999,030 | * | 3/1991 | Skinner et al. | 48/203 |

FOREIGN PATENT DOCUMENTS

| | | | | |
|---|---|---|---|---|
| 87102473 | | 6/1988 | (CN) . | |
| 2068014 | * | 8/1981 | (GB) | 48/206 |

* cited by examiner

*Primary Examiner*—Robert J. Warden, Sr.
*Assistant Examiner*—Sean Conley
(74) *Attorney, Agent, or Firm*—Nath & Associates PLLC; Gary M. Nath; Donald M. Sandler

(57) ABSTRACT

Combustible gases from pulverized solid fuel are generated by semi-coking the pulverized solid fuel in a reactor in the absence of oxygen to produce a solids stream that includes carbonaceous material and a gas stream that includes hydrocarbon gases and tar fumes. The carbonaceous material in the solids stream is gasified in a fluidized bed using steam and hot air to produce an output stream that includes combustible gases and coke particles. The output stream is combined with the gas stream to form a combined stream which is separated into a combustible gas stream and a hot particulate stream. At least a part of the hot particulate stream is applied to the reactor.

2 Claims, 1 Drawing Sheet

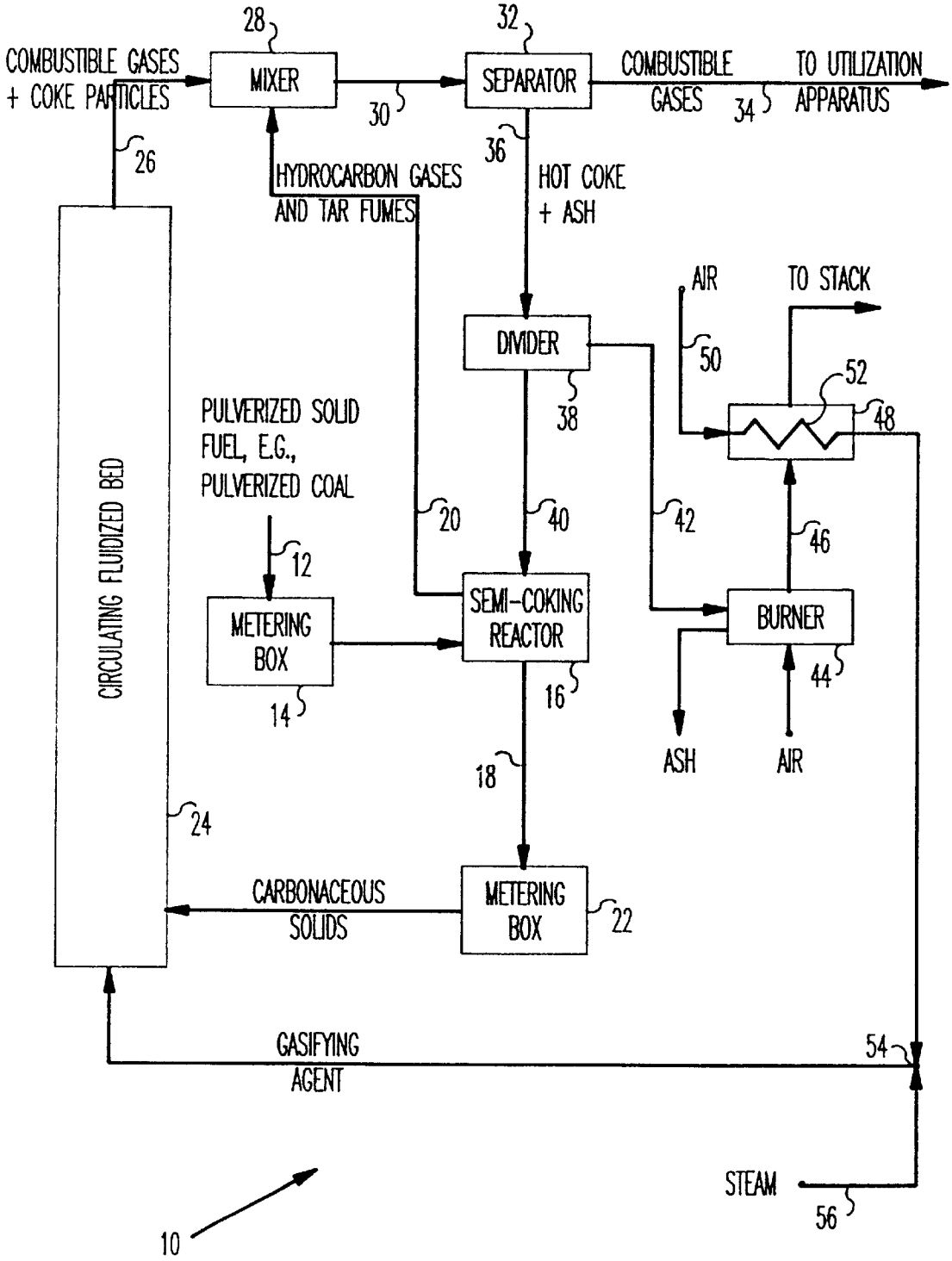
COMBUSTIBLE GASES
+ COKE PARTICLES
28
MIXER
30
32
SEPARATOR
COMBUSTIBLE
GASES
34
TO UTILIZATION
APPARATUS
26
36
HYDROCARBON GASES
AND TAR FUMES
HOT COKE
+ ASH
AIR
TO STACK
DIVIDER
50
52
38
48
PULVERIZED SOLID
FUEL, E.G.,
PULVERIZED COAL
20
40
42
46
12
CIRCULATING FLUIDIZED BED
METERING
BOX
SEMI-COKING
REACTOR
BURNER
14
16
44
ASH
AIR
18
24
CARBONACEOUS
SOLIDS
METERING
BOX
22
GASIFYING
AGENT
54
STEAM
56
10

METHOD OF AND APPARATUS FOR PRODUCING COMBUSTIBLE GASES FROM PULVERIZED SOLID FUEL

TECHNICAL FIELD

This invention relates to a method of and apparatus for producing combustible gases from pulverized solid fuel such as pulverized coal, and more particularly, coal having a high ash content. It is particularly suitable for use in power plants that generate heat or electricity.

BACKGROUND OF THE INVENTION

The Winkler Process is a well-known method of solid fuel gasification using a fluidized bed. In this process, crushed or pulverized fuel is gasified in a fluidized bed using blast steam-oxygen, or steam-air, forced draft. This one-step process works well for the gasification of lignites; but problems are encountered in the case of bituminous coals. Such problems arise because of the high content of volatile substances in bituminous coals which produce considerable amounts of tars in the gasification process. The gasification process carbonizes the tar into particles that tend to agglomerate; and this adversely affects the reliability of gas producers of this kind.

Another well-known process of gasification of coal involves a counter-flow, multiple-stage, fluidized bed. In this process, the coal is initially outgassed by uncleaned gas, and semi-coked by hot uncleaned low-calorie producer gas, which is fed to the using equipment (a boiler plant or gas turbine) following dust removal and proper cleaning. This method is sometimes referred to as the Westinghouse process prototype.

It is an object of the present invention to provide a new and improved method of and apparatus for generating combustible gases from pulverized coal, and more particularly, coal having a high ash content, which overcome or substantially ameliorates the problems of the prior art described above.

BRIEF DESCRIPTION OF THE INVENTION

The present invention provides a method of and apparatus for generating combustible gases from pulverized solid fuel such as pulverized coal by semi-coking and predrying the pulverized coal in a reactor in the absence of oxygen to produce a solids stream that includes carbonaceous material and a gas stream that includes hydrocarbon gases and tar fumes. The carbonaceous material in the solids stream is gasified in a fluidized bed using steam and hot air to produce an output stream that includes combustible gases and coke particles. The output stream is combined with the gas stream to form a combined stream which is separated into a combustible gas stream and a hot particulate stream. At least a part of the hot particulate stream is applied to the reactor.

The fluidized bed used in this invention should have a larger mass of inert material than fresh fuel than is used in conventional processes, e.g., the Westinghouse process, in order to prevent agglomeration of particles in the reactor due to the application to the reactor of the hot particulate stream as the heat transfer agent for semi-cocking. Preferably, the mass ratio of inert material to fresh fuel in the fluidized bed is not less than about 2:1, and preferably lying between 2:1 to 12:1, although the ratio may be even higher.

The present invention also includes dividing the hot particulate stream into a first portion that is applied to the reactor and a second portion that is burned to produce flue gases, and transferring heat from the flue gases to air for producing the hot air used for the fluidized bed. Preferably, the burning of the second portion is carried out using air above the stoichiometric value, and effectively flame neutralizes toxic substances, e.g., phenols, $CaSO_4$ carbon disulfide, etc.

BRIEF DESCRIPTION OF THE DRAWINGS

An embodiment of the present invention is described by way of example with reference to the accompanying drawing whose single figure shows a block diagram of an embodiment of the present invention for generating combustible gases from pulverized solid fuel.

DETAILED DESCRIPTION

Referring now to the drawing, reference numeral 10 designates apparatus according to the present invention for generating combustible gases from pulverized solid fuel such as pulverized coal. Apparatus 10 includes a source of pulverized coal indicated by reference numeral 12 which is conveyer fed into metering box 14 in order to regulate the flow of fresh fuel to the apparatus. Metering box 14 feeds fresh fuel to semi-coking reactor 16 wherein the fuel is heated by hot particulate in the absence of oxygen producing solids stream 18 that includes carbonaceous material, and gas stream 20 that includes hydrocarbon gases and tar fumes.

Solids stream 18 is applied to metering box 22 which is effective to regulate the amount of solids from reactor 16 applied to circulating fluidized bed 24. In bed 24, the carbonaceous material in the solids stream is gasified using a gasifying agent such as steam-oxygen or steam-air. Preferably, the agent is steam and hot air applied to the bottom of the bed which produces output stream 26 that includes combustible gases and coke particles. The output stream is mixed in mixer 28 with gas stream 20 produced by reactor 16 to produce combined stream 30. Separator 32 receives the combined stream and separates the same into combustible gas stream 34 and hot particulate stream 36. Preferably, separator 32 is a cyclone separator.

At least a part of the hot particulate stream is applied to reactor 16. Specifically, the hot particulate stream is applied to divider 38 which is adjustable to selectively divide the hot particulate stream into two portions, first portion 40 which is applied to reactor 16, and second portion 42 which is applied to burner 44. Preferably, the ratio of the mass of solids in the first portion to the mass of fuel applied to reactor 16 by metering box 14 is in the range 2:1 to 12:1 depending on the properties of the coal in source 12.

Second portion 42 is coexisted in burner 44 using air in excess of the stoichiometric value producing flue gases 46 that are applied to indirect heat exchanger 48 before being directed to a stack (not shown). Ambient air at 50 is passed through heat exchange tubes 52 and is thus heated by the flue, gases forming hot air that is combines at 54 with steam from source 56 to form the gasifying, agent for bed 24.

In operation, the pulverized coal delivered to reactor 16 is first dried in the reactor by the hot particulate in first portion 40. The subsequent destruction in the reactor of the organic material in the fuel is accompanied by the release of combustible gases and tar fumes, and the formation of a solid residue of semi-coke and ash which forms a part of the heat transfer agent in reactor 16. The combustible gases and tar fumes are combined with the hotter combustible gases produced by gasifier 24 in mixer 28. In combined stream 30, the tar fumes are destroyed by the high temperature of the coke particles and combustible gases produced by the gasifier.

Separator 32 is effective to remove sufficient particles such that combustible stream 34 may be used, without further cleaning, in a power plant for generating steam, for example. If stream 34 is to be in a gas turbine, further ash removal may be necessary.

As indicated above, the burning of the fuel left in the ash applied to burner 44 must be done with excess of air above the stoichiometric value, particularly if limestone is used to fix sulfur oxides in the coal fuel In the course of this combustion or reburning process, noxious compounds formed at the fuel semi-coking and gasification stages and carried away in the ash (phenols, carbon disulfide, etc.) are neutralized, and $CaSO_3$ is further oxidized to form harmless and stable $CaSO_4$ (gypsum).

The continuity of the process of semi-coking and semi-coke gasification, linked by a common solid heat-transfer agent circuit, makes it easy to control the process and ensures its stability.

It has been confirmed experimentally that prior semi-coking enhances the gasification process by a factor of 2 or 3 as compared with the gasification of coal not subjected to thermal pre-treatment.

The advantages and improved. results furnished by the method and apparatus of the present invention are apparent from the foregoing description of the preferred embodiment of the invention. Various changes and modifications may be made without departing from the spirit and scope of the invention as described in the appended claims.

What is claimed is:

1. A method for generating combustible gases from a solid fuel comprising:

a) semi-coking the solid fuel in a reactor in the absence of oxygen to produce a solids stream that includes carbonaceous material and a gas stream that includes hydrocarbon gases and tar fumes;

b) gasifying the carbonaceous material in said solid stream in a fluidized bed using steam and hot air to produce an output stream that includes combustible gases and coke particles;

c) combining said output stream with said gas stream to form a combined stream;

d) separating said combined stream into a combustible gas stream and a hot particulate steam;

e) dividing said hot particulate stream into a first portion that is applied to said reactor and a second portion that is burned to produce flue gases, and transferring heat from said flue gases to air for producing said hot air.

2. A method according to claim 1 wherein the step of burning said second portion is carried out using air above the stoichiometric value.

* * * * *